US011388510B2

(12) United States Patent
Craven et al.

(10) Patent No.: US 11,388,510 B2
(45) Date of Patent: Jul. 12, 2022

(54) MICROPHONE ARRAYS PROVIDING IMPROVED HORIZONTAL DIRECTIVITY

(71) Applicants: Peter Graham Craven, Haslemere (GB); Christopher Julian Travis, Wotton-Under-Edge (GB)

(72) Inventors: Peter Graham Craven, Haslemere (GB); Christopher Julian Travis, Wotton-Under-Edge (GB)

( * ) Notice: Subject to any disclaimer, the term of this patent is extended or adjusted under 35 U.S.C. 154(b) by 765 days.

(21) Appl. No.: 16/305,745

(22) PCT Filed: Jun. 2, 2017

(86) PCT No.: PCT/GB2017/051600
§ 371 (c)(1),
(2) Date: Nov. 29, 2018

(87) PCT Pub. No.: WO2017/208022
PCT Pub. Date: Dec. 7, 2017

(65) Prior Publication Data

US 2021/0289291 A1 Sep. 16, 2021

(30) Foreign Application Priority Data

Jun. 3, 2016 (GB) ..... 1609784

(51) Int. Cl.
*H04R 1/40* (2006.01)
*H04R 5/027* (2006.01)
*H04S 3/00* (2006.01)

(52) U.S. Cl.
CPC ..... *H04R 1/406* (2013.01); *H04R 5/027* (2013.01); *H04S 3/00* (2013.01); *H04S 2420/11* (2013.01)

(58) Field of Classification Search
None
See application file for complete search history.

(56) References Cited

U.S. PATENT DOCUMENTS 5,377,166 A 12/1994 Kuhn
8,406,436 B2 * 3/2013 Craven ..... H04R 5/027 381/170
2007/0147634 A1 6/2007 Chu

FOREIGN PATENT DOCUMENTS

JP S6031398 A 2/1985
JP 2007005969 A 1/2007
(Continued)

OTHER PUBLICATIONS

"Patents Act 1977: Combined Search and Examination Report under Sections 17 and 18(3)" dated Jul. 20, 2016, for GB Application No. GB1609784.2, 6 pp.
(Continued)

*Primary Examiner* — Kenny H Truong
(74) *Attorney, Agent, or Firm* — Buckley, Maschoff & Talwalkar LLC

(57) ABSTRACT

A compact multi-element microphone has two rings of directional sensors. Using simple analog electronics, it delivers first-order outputs with low noise, wide bandwidth and tight transient response. The double-ring structure provides exceptionally high directional fidelity in the horizontal plane, while also keeping out-of-plane behaviour under control. This enables faithful capture of ambience, reflections and reverberation. A non-radial capsule arrangement moderates cavity resonances and reduces shading. Combined with digital electronics, the array can efficiently provide second-order and higher-order horizontal directivities that maintain their performance over a wider frequency range than with prior solutions. Outputs can be mono, two-channel stereo and multichannel surround sound. Applications include 360-degree immersive audio, with-height concert hall recording, and advanced voice capture using electronic steering of beams and nulls.

22 Claims, 2 Drawing Sheets

(56) References Cited

FOREIGN PATENT DOCUMENTS

| | | | |
|---|---|---|---|
| JP | 2007288679 | A | 11/2007 |
| JP | 2014116822 | A | 6/2014 |
| JP | 2014160953 | A | 9/2014 |
| WO | 2006/016156 | A1 | 2/2006 |
| WO | 2008/040991 | A2 | 4/2008 |
| WO | 2011/087770 | A2 | 7/2011 |

OTHER PUBLICATIONS

"International Search Report and Written Opinion" dated Aug. 7, 2017 (Aug. 7, 2017), for PCT Application No. PCT/GB2017/051600, 14 pp.

* cited by examiner

MICROPHONE ARRAYS PROVIDING IMPROVED HORIZONTAL DIRECTIVITY

CROSS-REFERENCE TO RELATED APPLICATIONS

This application is a U.S. National Stage filing under 35 U.S.C. § 371 and 35 U.S.C § 119, based on and claiming priority to PCT/GB2017/051600 for "MICROPHONE ARRAYS PROVIDING IMPROVED HORIZONTAL DIRECTIVITY" filed Jun. 2, 2017 and claiming priority to GB Application No. 1609784.2 filed Jun. 3, 2016.

FIELD OF THE INVENTION

The invention relates to the field of microphone arrays, and in particular to compact electronically steerable high-performance microphone arrays and the synthesis of high order directivities for sources in the horizontal plane.

BACKGROUND TO THE INVENTION

Many surround-sound music recordings are made using a spaced microphone arrangement to feed a 5-loudspeaker or 7-loudspeaker reproduction system via conventional panning and mixing processes. The microphone spacing in such spaced arrays is typically greater than 30 cm, and this unavoidably introduces a certain amount of temporal smear into the reproduced sound. An alternative approach is to capture surround-sound from a single point, or from a region not greatly exceeding the size of a human head, with the aim of reproducing as closely as possible the sound, including directional aspects, as it would have been heard by a human listener located at that point.

A notable attempt to provide a microphone array for this purpose was described in British patent GB1512514 ("Coincident microphone simulation covering three dimensional space and yielding various directional outputs" 1977, filed July 1974 by Craven, P. G. and Gerzon, M. A). The principle is of an array of microphone capsules arranged on the surface of a notional or actual sphere or polyhedron, with a matrix to derive linear combinations of the capsule outputs having directivities related to spherical harmonics. The first commercial embodiment known as the 'Soundfield' comprised a tetrahedral array of four outward-pointing cardioid capsules. In this design the array is not used to increase the directivity order of the array beyond that of the capsules—both are first order—but merely to provide a multichannel output in a form suitable for further processing and transmission.

Some essentially spherical designs providing higher directivity than that of the capsules themselves have been produced for acoustic experimentation (J. Meyer and G. Elko, "A highly scalable spherical microphone array based on an orthonormal decomposition of the soundfield," in Acoustics, Speech, and Signal Processing (ICASSP), 2002 IEEE International Conference on, vol. 2, 2002, pp. 11-1781 to II-1784.; and Laborie, A; Bruno, R; Montoya, S, "A New Comprehensive Approach of Surround Sound Recording" Audio Eng. Soc. 114th Convention, February 2003, AES preprint #5717) but it is difficult to combine second-order or higher-order directivity with high audio quality over a frequency range such as 20 Hz-20 kHz. The paper Rafaely, B., "Design of a Second-Order Soundfield Microphone", Audio Eng. Soc. 118th Convention (Barcelona 2005), AES preprint #6405 exposes the difficulties that arise when attempting to synthesise second-order directivity from an array of pressure sensors, i.e. omnidirectional capsules, which intrinsically have a zero-order directivity. A principal such difficulty is the need to provide very substantial boost at the low audio frequencies. The required boost can be reduced very substantially if the second-order directivity is instead synthesised from the outputs of directional sensors having intrinsic first order directivity such as cardioid capsules or figure-of-eight capsules.

Practical directional sensors often have a shape approximating to a disc or drum, so four or more such sensors if closely spaced and pointing outwards will enclose a central space, leading to the possibility of a cavity resonance. This is one reason why the arrays described in Craven, P. G., Law, M. J. and Travis, C. J., "Microphone Array" WO 2008/040991 A2 departs from previous practice in that the capsules do not point outwards but instead are tangential.

In a three-dimensional microphone array, the number of capsules required grows as the square of the order of harmonic required. Many commercial recording applications attach lower importance to vertical directional resolution than to horizontal and it might seem obvious to replace the spherical array by a circular ring of microphone capsules. Ring arrays using omnidirectional capsules and using figure-of-eight capsules have been considered by Meyer (Meyer, J, "Beamforming for a circular microphone array mounted on spherically shaped objects", J. Acoust. Soc. Am. 109 (1), January 2001) while Rahim et al. consider omnidirectional elements and "1+cos(φ)elements", i.e. cardioid capsules (T. Rahim and D. E. N. Davies, "Effect of directional elements on the directional response of circular arrays," Proc. IEE Pt. H 129, 18-22 1982).

However, most array designs require frequency response equalisation and a ring array that is equalised for a substantially flat response to horizontal sounds will typically have a rising high-frequency response to sounds from the vertical or near-vertical direction. Even if there is no desire to record as accurately the reflections from a ceiling in the original recording location, their presence with high frequency boost can result in an unsatisfactory recording overall.

What is needed is an array geometry that allows a high directivity in the horizontal plane without unduly emphasising high frequencies from other directions and with low susceptibility to cavity resonance effects.

SUMMARY OF THE INVENTION

In a first aspect of the invention a sound capture device comprising two nonconcentric rings of directional microphone capsules, each ring oriented at an angle of at least 70 degrees relative to a notional reference axis passing through the centres of the two rings, and each location that is off the reference axis having an azimuthal angle around the reference axis.

The term 'azimuthal angle' refers to an angle of rotation around the reference axis relative to some arbitrary fixed direction. We refer also to a 'notional equatorial plane' that lies symmetrically between the rings, and to a 'central point' which is the intersection of the equatorial plane and the reference axis.

A ring topology is efficient in providing high directional resolution in a horizontal plane from a given number of capsules, while the use of two separated rings allows control over the rise in high-frequency response for near-vertical source directions that is a known problem for a single ring. For best performance the rings should ideally be perpendicular to the reference axis but analysis indicates that a deviation in orientation of up to 20 degrees does not degrade the performance unacceptably.

The centre-to-centre distance of each microphone capsule to its nearest neighbour capsule within the same ring is less than one wavelength at an audio frequency of 4 kHz, which in dry air at 20° C. is 86 mm. This allows coherent addition within subsequent matrix processing, avoiding deep frequency response variations within the most critical parts of the audio frequency range.

Each ring contains n directional microphone capsules, with n≥3, and each capsule is intrinsically responsive to both pressure and velocity and has an axis of maximum intrinsic sensitivity. These features allow matrix processing to derive Ambisonic W, X, and Y signals with high signal-to-noise ratio, separately from each ring if desired.

The axis of maximum intrinsic sensitivity of each directional microphone capsule forms a nonzero angle with a line from the central point to that capsule. As explained in the description, the physical shape of typical capsules tends to result in cavity resonance effects if the capsules' axes are colinear with the lines joining each one to the central point. Analysis suggests that it is beneficial for the nonzero angle to be greater than 45 degrees.

Preferably, each ring is perpendicular to the reference axis. This orientation promotes regularity in the subsequent processing and uniformity of the response to sources at all directions in the equatorial plane.

Preferably, the rings are circular. This configuration simplifies the subsequent processing and promotes uniformity of the response to sources at all directions in the equatorial plane.

As explained above, n≥3 allows matrix processing to derive Ambisonic W, X, and Y signals with high signal-to-noise ratio, separately from each ring if desired. However, for low-cost applications n=3 is preferred, as this simple arrangement allows Ambisonic W, X, Y signals to be derived with high accuracy.

For some applications it is preferred that n≥4, as this allows a second-order spherical harmonic output to be derived from each ring separately by means of matrixing and equalisation. However, for certain applications n=4 is preferred for simplicity.

For critical applications it is preferred that n≥5, allowing Ambisonic U and V signals to be derived separately from each ring and thus avoid distortion of the horizontal polar pattern when sources move slightly off the horizontal plane.

For full-bandwidth high-fidelity applications, it is preferred that the centre-to-centre distance of each capsule to its nearest neighbour capsule within the same ring is less than one wavelength at an audio frequency of 20 kHz, which in dry air at 20° C. is 17 mm.

Preferably, the azimuthal angles of the microphone capsules in each one of the two rings interleave those of the capsules in the other ring. The interleaving property allows the horizontal resolution to be equivalent to that of a single ring having twice the number of capsules, notwithstanding that such a single ring of the same size could not be physically constructed because of the finite sizes of the capsules.

Preferably, each microphone capsule is tilted such that its axis of maximum intrinsic sensitivity forms an angle with the equatorial plane that has a magnitude of between 20 degrees and 50 degrees, in order to provide a good signal-to-noise ratio on a derived Ambisonic Z signal as well as on derived X and Y signals.

Preferably, the magnitude of the angle of tilt is the same for all of the microphone capsules in the two rings to permit more regular processing when the outputs from capsules in the two rings are combined.

Preferably, each microphone capsule is tilted such that its axis of maximum intrinsic sensitivity points towards the equatorial plane in order to reduce the susceptibility to cavity resonance effects with typical capsule shapes.

Preferably, the axes of maximum intrinsic sensitivity of the capsules in a first one of the two rings all pass through a first mutual point on the reference axis, and the axes of maximum intrinsic sensitivity of the capsules in the other of the two rings all pass through a second mutual point on the reference axis. The first and second mutual points are not necessarily distinct, but generally are not co-located. Designs having a greater separation between the two mutual points have less susceptibility to cavity resonance effects It is preferred that the microphone capsules point outwards rather than inwards, when considered in plan view, and that each provides a relative suppression at least 6 dB for sound sources 180 degrees away from its azimuthal direction. This helps to avoid the creation of frequency response nulls; moreover the larger response from the capsule that receives the sound first helps to create an impulse response with a fast initial rise.

Preferably, the two rings have the same dimensions in order to preserve symmetry about the equatorial plane and thus minimise the dependence of response on source altitude for sources slightly off the equator.

Preferably, the centre-to-centre distance of each microphone capsule to its nearest neighbour capsule within the same ring is the same for all of the capsules in the two rings, to promote regularity and simplify beamforming.

In a second aspect of the invention the sound capture device comprises matrix means to derive Ambisonic signals W, X and Y from the outputs of the capsules in the two rings in order to facilitate surround-sound reproduction.

Preferably, the matrix means also comprises means to derive Ambisonic signal Z from the outputs of the capsules in the two rings, thereby allowing surround-sound with height reproduction.

Preferably, the sound capture device also comprises matrix and equalisation means to derive Ambisonic signals U and V from the outputs of the microphone capsules in the two rings, thereby permitting higher directional discrimination in a subsequent surround-sound presentation of a recording.

In a third aspect of the invention the sound capture device comprises beamforming means to derive one or more directional feeds having at least second-order horizontal directivity from the outputs of the microphone capsules in the two rings. Such feeds can be thought of as synthesized outputs of virtual microphones co-located at the centre of the array. A collection of five such feeds can deliver second-order horizontal surround sound.

BRIEF DESCRIPTION OF THE DRAWINGS

Examples of the present invention will be described in detail with reference to the accompanying drawings, in which.

DETAILED DESCRIPTION

Terminology

Figure 1:
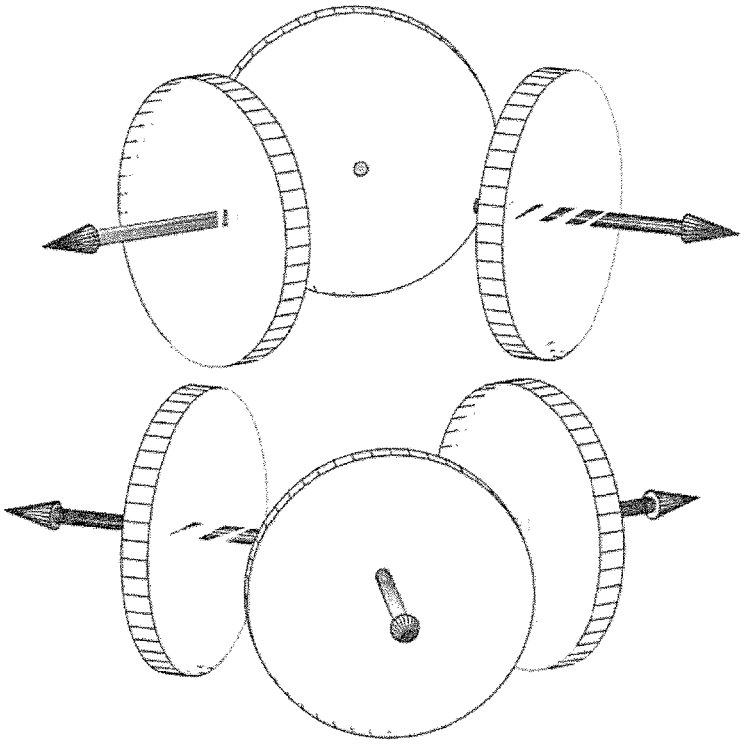
FIG. 1 shows a perspective side view of two staggered rings of microphone capsules, each ring having three directional capsules.

According to Ambisonic tradition, the outputs of a directional array are considered as being composed of spherical harmonics. Other directivities such as cardioid or 'shotgun' patterns can then be synthesised as linear combinations of harmonics of various degree. There is one harmonic of degree 0, termed omnidirectional and labelled W, and three harmonics of degree 1 labelled X, Y and Z, corresponding to figure-of-eight directivities pointing in the x, y and z directions, respectively. In general there are (2m+1) harmonics of degree m. It may be helpful to note here that terms such as 'omnidirectional' can be applied both to a capsule directivity and to the output of an array of capsules.

Also, that the term 'order' has two distinct uses. In mathematical descriptions 'order' is used to identify one of the several harmonics of a given degree and is denoted by "m" in the standard notation $Y_l^m$ (see https://en.wikipedia.org/wiki/Spherical_harmonics). On the other hand, a phrase such as "first order microphone" denotes a microphone whose directional response is a linear combination of harmonics of degree not exceeding 1; similarly "second order directivity" denotes a directivity composed of harmonics of degree including but not exceeding 2.

We shall use the terms "pressure sensor" and "omnidirectional capsule" interchangeably. Similarly, figure-of-eight capsules are referred to in the literature variously as dipole sensors, bidirectional capsules, velocity microphones or pressure-gradient microphones.

Criteria

In concert-hall recording the direct sound from an orchestra will arrive from mainly horizontal directions but there is also reverberant sound which, in the absence of a better model, we will consider as a diffuse or isotropic field. It is assumed that correct timbral reproduction of the orchestral instruments requires a flat frequency response for horizontal sources but the overall sound of the recording also depends on the response to the reverberation. If rising at high frequencies, the recording may sound too bright and shrill. If falling substantially, the recording may sound dull, claustrophobic, lifeless or airless. Although reverberation in a real hall is not isotropic, a recording system providing a reasonably flat response to a diffuse field is nevertheless recommended.

In a recording system that is equalised for flat response to horizontal sources, the diffuse frequency response is thus a useful indicator which we shall call the 'equalised diffuse response'. It is related to the established parameter of 'directivity index' but our emphasis is on uniformity over the frequency range. A 3-D spherically symmetric microphone array equalised to provide a flat response for horizontal sources will automatically have a uniform equalised diffuse response, but in a 2-D design this aspect requires separate consideration.

Ring Array Response

The mathematics of ring responses has hitherto been developed mainly for rings of pressure sensors. The responses of rings of velocity sensors have been partially explored in the above-cited papers by Meyer and by Rohan et. al., but as the mathematics is less than straightforward we shall rely on qualitative and intuitive arguments.

If the individual capsules are omnidirectional, an omnidirectional array response can be furnished by taking the output from just a single capsule. However, we require all the directional responses to be "coincident", i.e. to be referred to the same point in space, the centre of the array. It is a significant challenge to synthesise multiple coincident responses in which each omnidirectional and first-degree response has the same audio quality and directional accuracy as a single microphone capsule having the same nominal polar diagram and placed at the same reference point. We shall discuss firstly the directional accuracy of the omnidirectional output of a ring array.

If the outputs of a horizontal ring of equally spaced pressure sensors are added with equal weighting, then by symmetry the result will approximate the output of an omnidirectional sensor placed at the centre of the ring. The approximation is good at low frequencies but at higher frequencies two adverse effects become significant. The first is periodic azimuthal variation of the high frequency response as the angle of a source changes within the horizontal plane. The second is a rising equalised diffuse response which results from the fact that for a source vertically overhead the capsules receive the sound simultaneously, so their outputs add coherently, while for horizontal sources the sound reaches the nearest capsule first and the furthest later, resulting in droop and even nulls in the response to high frequencies. If equalisation is now applied to flatten the response to horizontal sources, the response to vertical and near-vertical sources will be boosted excessively, hence the rising equalised diffuse response.

The azimuthal variation is related to the number of capsules in the ring: in general the response when a source is directly in line with a capsule will be different from the response to intermediate source positions. If with a given ring radius, the number of capsules can be increased until the capsule spacing becomes small compared with wavelength, this variation can be made insignificant. Unfortunately, the physical size of practical capsules will generally force a larger ring size when the number is increased, to avoid capsule overlap. The azimuthal advantage is then less clear and the rise in the equalised diffuse response is certainly made worse—it will start at a lower frequency.

With a ring of outward-pointing cardioid capsules an approximately omnidirectional response can again be obtained at low frequencies by unweighted addition of the capsule outputs. Alternatively, if the capsule outputs are weighted by $\cos(\varphi)$ or by $\sin(\varphi)$, where $\varphi$ is the capsule azimuth relative to a reference direction in the plane of the ring, then the addition will furnish a figure-of-eight array output pointing in the reference direction or at right angles to it. Both the omnidirectional and figure-of-eight array outputs will be good at low frequencies but at higher frequencies will suffer from both an unwanted periodic azimuthal variation and a nonuniform equalised diffuse response in broadly the same way as for the ring of omnidirectional sensors, though the precise details will be different.

Figure 2:
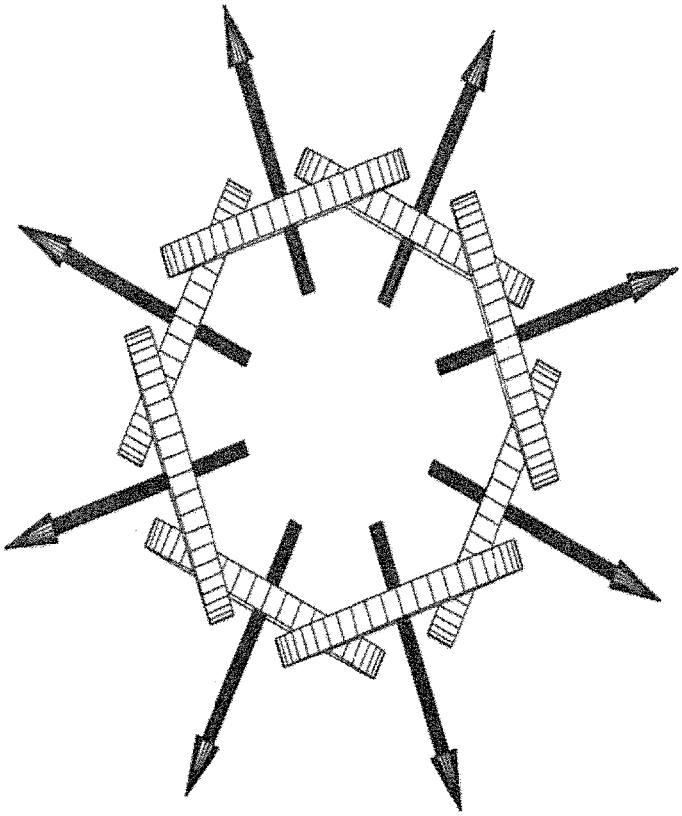
FIG. 2 shows a top view of two staggered rings of microphone capsules, each ring having four directional capsules.

A ring of omnidirectional sensors will generally suffer from unequalisable deep nulls in the horizontal response (see FIG. 2 of the above-cited paper by Rahim and Davies). As already noted, sound is picked up firstly by the closest capsule(s) and some short time later by the capsules on the 'other' side, 180 degrees away in azimuth. Interference between these two arrivals, plus others at intermediate times, creates the nulls. A cardioid array largely avoids this problem as the cardioid capsules on the 'other' side are pointing in the opposite direction and will ideally not respond and interfere.

Nevertheless, a cardioid ring still suffers from horizontal droop and it is difficult to avoid an unacceptable rise in the equalised diffuse response. We note that high-performance cardioid capsules are rarely smaller than ~1 cm in radius so the ring cannot practically be made smaller than the wavelength of the highest frequency of interest, for example 15 kHz or higher.

Double Ring

The invention firstly seeks to ameliorate the rise in equalised diffuse response by using two horizontal rings, arranged vertically one above the other. If the processed outputs of the two rings are added, the response to near-vertical sounds acquires a high-frequency droop because the contributions from the upper and lower rings are slightly delayed with respect to each other. By adjusting the spacing between the rings one may approximately match this droop in the response to near-vertical sounds with the droop to horizontal sounds already recited, and thus obtain a more nearly flat equalised diffuse response when the horizontal response is equalised.

The invention secondly seeks to confer the advantages of a small ring with those of a large number of capsules—larger than could be accommodated on a single ring of the same size. It does so by staggering the azimuths of the capsules in the two rings such that each capsule in the upper ring lies above a point approximately midway between two adjacent capsules in the lower ring.

This arrangement is shown for the case of three outward-pointing cardioid capsules in each ring in FIG. 1. For clarity, the two rings are shown as more widely separated than would likely be desirable in practice. The capsules are depicted as circular discs, each with its direction of maximum sensitivity normal to the plane of the disc as shown by the arrow.

Although the capsule axes in FIG. 1 pass through the array's vertical reference axis, the invention does not rely on this being the case. Indeed, giving the capsules some skew may allow them to be placed closer together.

FIG. 2 illustrates how a double ring each of four capsules has eight-fold symmetry when viewed from above. Response modelling is simplified if the capsules can be considered as acoustically transparent. Such modelling confirms the advantage that the response to horizontal sounds is equivalent to a single ring of the same size containing twice the number of capsules, notwithstanding that such a single ring could not be built because the capsules would overlap.

As noted above, the double ring allows the equalised diffuse response to be made flatter than would be the case with a single ring.

Figure 3:
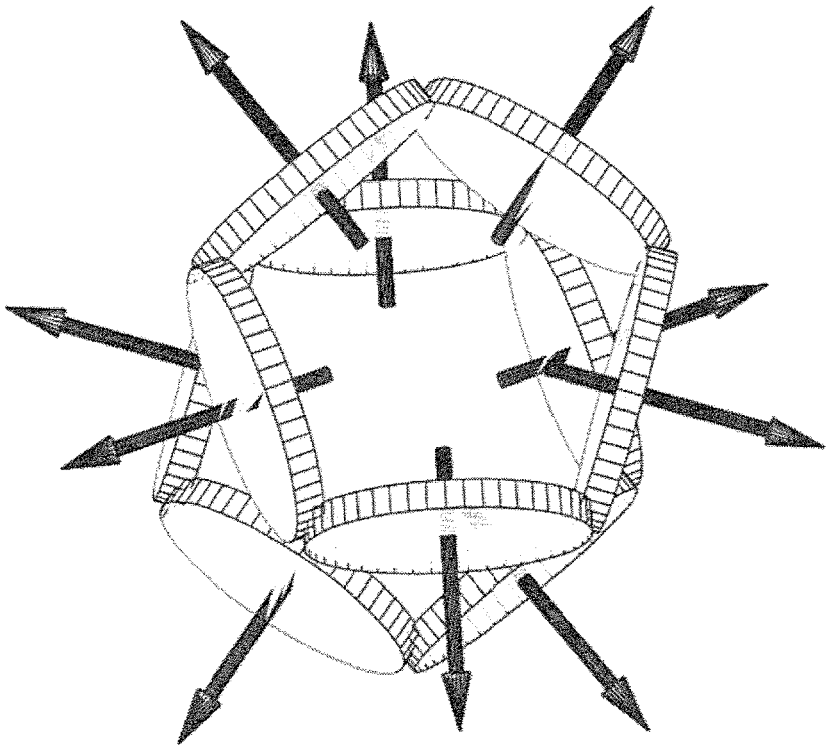
FIG. 3 shows a perspective view of two staggered rings of microphone capsules, each ring having five directional capsules.

Nevertheless, some difficulties remain. With capsules of a practical size, for example 1 cm in radius, the equalised diffuse response can be substantially flat below 5 kHz but interference wiggles in the frequency responses are difficult to avoid at higher frequencies, certainly above 10 kHz. Another problem is that it would be ideal if the omnidirectional and figure-of-eight array outputs each had a substantially flat equalised diffuse response, but the ring spacing that achieves that result may be different for those two outputs. And finally we need to be aware that the assumption of acoustically transparent capsules prevents the modelling from predicting cavity resonance effect that may arise in practice. One might conjecture that an array of substantially disc-shaped outwards-pointing capsules could create a cylindrical space that could be troublesome in this respect, as suggested by FIG. 3, which depicts two rings each having five capsules.

Figure 4:
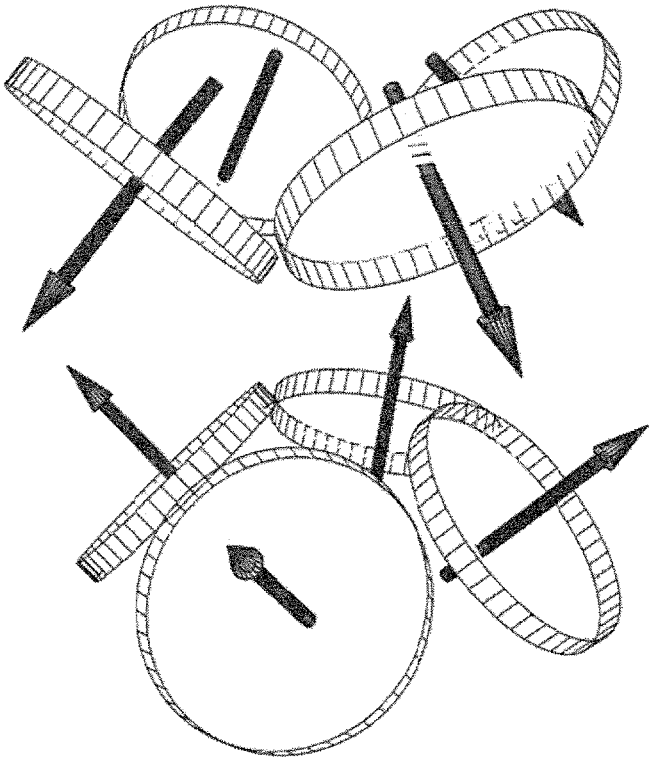
FIG. 4 shows a perspective side view of two staggered rings of microphone capsules, each ring having four directional capsules tilted to provide directivity in the vertical direction.

Accordingly, the invention in a preferred embodiment provides for the capsules to be tilted as shown in FIG. 4, such that the maximum sensitivity of the capsules in the upper ring points slightly downwards and the maximum sensitivity of the capsules in the lower ring points slightly upwards. This removes the obvious cylindrical cavity and it also provides a basis to derive an Ambisonic Z signal by summing the capsule outputs using a positive weight for the upward-facing capsules in the lower ring and a negative weight for the downward-facing capsules in the upper ring.

A theoretical disadvantage of the tilt is that the tilted cardioid capsule no longer provides complete rejection of horizontal sounds from an azimuth 180 degrees away so there is a less complete avoidance of the interference nulls as noted above for omnidirectional capsules but simulations have shown that the horizontal responses nevertheless seem very satisfactory. Supercardioid capsules or hypercardioid capsules may be helpful if further control of nulls is required.

In FIG. 4, the upper and lower rings are shown widely separated for clarity. In practice the distance would be adjusted to optimise the equalised diffuse response, a closer spacing reducing the droop in the response to near-vertical sources. Similarly there is choice about the angle of tilt, a larger tilt providing a larger vertical response and hence better signal-to-noise ratio in a derived Z output, at the expense of weaker X and Y signals. A tilt angle of 30 degrees may be a good compromise. Tilt angles larger than 45 degrees may result in significant impulse response degradation as a result of specular reflection of horizontal sounds from the upper ring to the lower, or vice versa, while very small tilt angles will provide only weak suppression of possible cylindrical cavity resonances.

Matrixing

Ambisonic signals such as W, X, Y, Z, U and V may be delivered as outputs or used for beamforming. They are obtained by adding all capsule outputs with a weighting function $w(\varphi)$ where $\varphi$ is the azimuthal angle of a capsule relative to the x-axis and is the azimuthal angle of the source:

| Symbol | Array output description | Horizontal directivity | Capsule weight $w(\varphi)$ |
|---|---|---|---|
| W | Omnidirectional | 1 | 1 |
| X | Forward-pointing figure-of-eight | $\cos(\theta)$ | $\cos(\varphi)$ |
| Y | Sideways-pointing figure-of-eight | $\sin(\theta)$ | $\sin(\varphi)$ |
| Z | Upward-pointing figure-of-eight | — | +1 for the lower ring; −1 for the upper ring |
| U | Forward-pointing clover-leaf | $\cos(2\theta)$ | $\cos(2\varphi)$ |
| V | Skew clover-leaf | $\sin(2\theta)$ | $\sin(2\varphi)$ |

These weightings ignore normalisation, which will depend on the capsule directivity, for example supercardioid versus cardioid, and also on the capsule tilt angle. The U and V signals will generally require bass equalisation since with first order capsule directivity these derived second degree signals will have a response only by virtue of the capsule separation and reducing by 6 dB per octave at low frequencies.

The above table can easily be extended to include the third-order signals that are sometimes referred to as P and Q.

These signals require n≥4 if the capsules are staggered or n≥7 otherwise. They will require equalisation of approximately 12 dB per octave in their frequency band of interest.

Beamforming methods for other directivities have been extensively discussed in the literature, for example a forward-pointing 'shotgun' microphone may be synthesised as W/sqrt(2)+X+U but there are many other possibilities.

General Comments

The capsules may be conventional condenser types, or any other type of acoustic sensor, including MEMS and optical. They may also be composite sensors that contain separate elements. For example, they may contain a pressure-sensing element and velocity-sensing elements, plus signal combining means.

The invention has been framed in terms of air-borne audio, but may equally be applied more widely, including underwater and in ultrasonic frequency bands. The arrays of the invention may be augmented in many ways already known in the field. The sound capture device may incorporate local baffles and/or absorption, and the geometry of these and the device's other acoustic and mechanical features may be tailored to be invariant under the same symmetry group as that of the capsules in the array. Arrays according to the invention may be built into other devices such as 360-degree video cameras.

The invention claimed is:

1. A sound capture device comprising two nonconcentric rings of directional microphone capsules, each ring defining a plane that is oriented at an angle of at least 70 degrees relative to a notional reference axis passing through the centres of the two nonconcentric rings, and each location that is off the reference axis having an azimuthal angle around the reference axis, wherein the device has a notional equatorial plane that lies symmetrically between the two rings of capsules, and the equatorial plane intersects the reference axis at a central point;

wherein the centre-to-centre distance of each microphone capsule to its nearest neighbour capsule within the same ring is less than one wavelength at an audio frequency of 4 kHz;

wherein each of the two rings contains n directional microphone capsules, with n≥3;

wherein each microphone capsule is intrinsically responsive to both pressure and velocity and has an axis of maximum intrinsic sensitivity that forms a nonzero angle with a line from the central point to that capsule; and wherein each directional microphone capsule is tilted such that its axis of maximum intrinsic sensitivity intersects the equatorial plane.

2. A sound capture device according to claim 1, wherein each of the planes defined by the two rings is perpendicular to the reference axis.

3. A sound capture device according to claim 1, wherein each of the two rings is circular.

4. A sound capture device according to claim 1, wherein n=3.

5. A sound capture device according to claim 1, wherein n≥4.

6. A sound capture device according to claim 1, wherein n=4.

7. A sound capture device according to claim 1, wherein n≥5.

8. A sound capture device according to claim 1, wherein the centre-to-centre distance of each microphone capsule to its nearest neighbour capsule within the same ring is less than one wavelength at an audio frequency of 20 kHz.

9. A sound capture device according to claim 1, wherein the azimuthal angles of the microphone capsules in one of the two rings interleave those of the capsules in the other of the two rings.

10. A sound capture device according to claim 1, wherein each directional microphone capsule is tilted such that its axis of maximum intrinsic sensitivity forms an angle with the equatorial plane that has a magnitude between 20 degrees and 50 degrees.

11. A sound capture device according to claim 10, wherein the magnitudes of the angles are the same for each of the microphone capsules in the two rings.

12. A sound capture device according to claim 1, wherein each directional microphone capsule is tilted such that its axis of maximum intrinsic sensitivity points towards the equatorial plane.

13. A sound capture device according to claim 1, wherein the axes of maximum intrinsic sensitivity of the microphone capsules in a first one of the two rings all pass through a first mutual point on the reference axis, and the axes of maximum intrinsic sensitivity of the capsules in the other of the two rings all pass through a second mutual point on the reference axis.

14. A sound capture device according to claim 1, wherein the sensitivity of each microphone capsule to sound from a distant source in the equatorial plane at the same azimuthal angle as the respective capsule is at least 6 dB greater than its sensitivity to sound from a distant source in the equatorial plane at 180 degrees to the azimuthal angle of said respective capsule.

15. A sound capture device according to claim 1, wherein the two rings have the same dimensions.

16. A sound capture device according to claim 1, wherein the centre-to-centre distance of each microphone capsule to its nearest neighbour within the same ring is the same for all of the microphone capsules in the two rings.

17. A sound capture device according to claim 1, further comprising a matrix processor to derive Ambisonic signals W, X and Y from the outputs of the microphone capsules in the two rings.

18. A sound capture device according to claim 17, wherein the matrix processor further derives Ambisonic signal Z from the outputs of the microphone capsules in the two rings.

19. A sound capture device according to claim 17, wherein the matrix processor further derives Ambisonic signals U and V from the outputs of the microphone capsules in the two rings.

20. A sound capture device according to claim 1, comprising a processor to derive a directional feed having at least second-order horizontal directivity from the outputs of the microphone capsules in the two rings.

21. A sound capture device according to claim 1, further comprising a matrix processor to derive Ambisonic signal Z from the outputs of the microphone capsules in the two rings.

22. A sound capture device according to claim 1, further comprising a matrix processor to derive Ambisonic signals U and V from the outputs of the microphone capsules in the two rings.

* * * * *